United States Patent [19]

Zosel

[11] 4,156,688

[45] May 29, 1979

[54] PROCESS FOR DEODORIZING FATS AND OILS

[75] Inventor: Kurt Zosel, Oberhausen, Fed. Rep. of Germany

[73] Assignee: Studiengesellschaft Kohle mbH, Mülheim an der Ruhr, Fed. Rep. of Germany

[21] Appl. No.: 814,614

[22] Filed: Jul. 11, 1977

Related U.S. Application Data

[63] Continuation of Ser. No. 630,827, Nov. 11, 1975, abandoned, which is a continuation of Ser. No. 369,689, Jun. 13, 1973, abandoned.

[30] Foreign Application Priority Data

Jun. 26, 1972 [AT] Austria ..... 5469/72

[51] Int. Cl.[2] ..... C11B 3/00

[52] U.S. Cl. ..... 260/420; 252/411 R; 260/428; 426/417

[58] Field of Search ..... 260/420, 428, 428.5; 426/417, 429, 430

[56] References Cited

U.S. PATENT DOCUMENTS

| | | | |
|---|---|---|---|
| 1,805,751 | 5/1931 | Averbach | 260/428.5 |
| 3,558,468 | 1/1971 | Wise | 208/8 |
| 3,843,824 | 10/1974 | Roselius et al. | 426/386 |

FOREIGN PATENT DOCUMENTS 1057911 2/1967 United Kingdom.

*Primary Examiner*—Patrick Garvin
*Assistant Examiner*—P. E. Konopka
*Attorney, Agent, or Firm*—Sprung, Felfe, Horn, Lynch & Kramer

[57] ABSTRACT

Process for deodorizing fat or oil containing odoriferous material by contacting the same with carbon dioxide at a temperature of 150° to 250° C. and a pressure of 100 to 250 atmospheres for the selective take-up by the carbon dioxide of the odoriferous material, thereby separating odoriferous material from the fat or oil.

8 Claims, 1 Drawing Figure

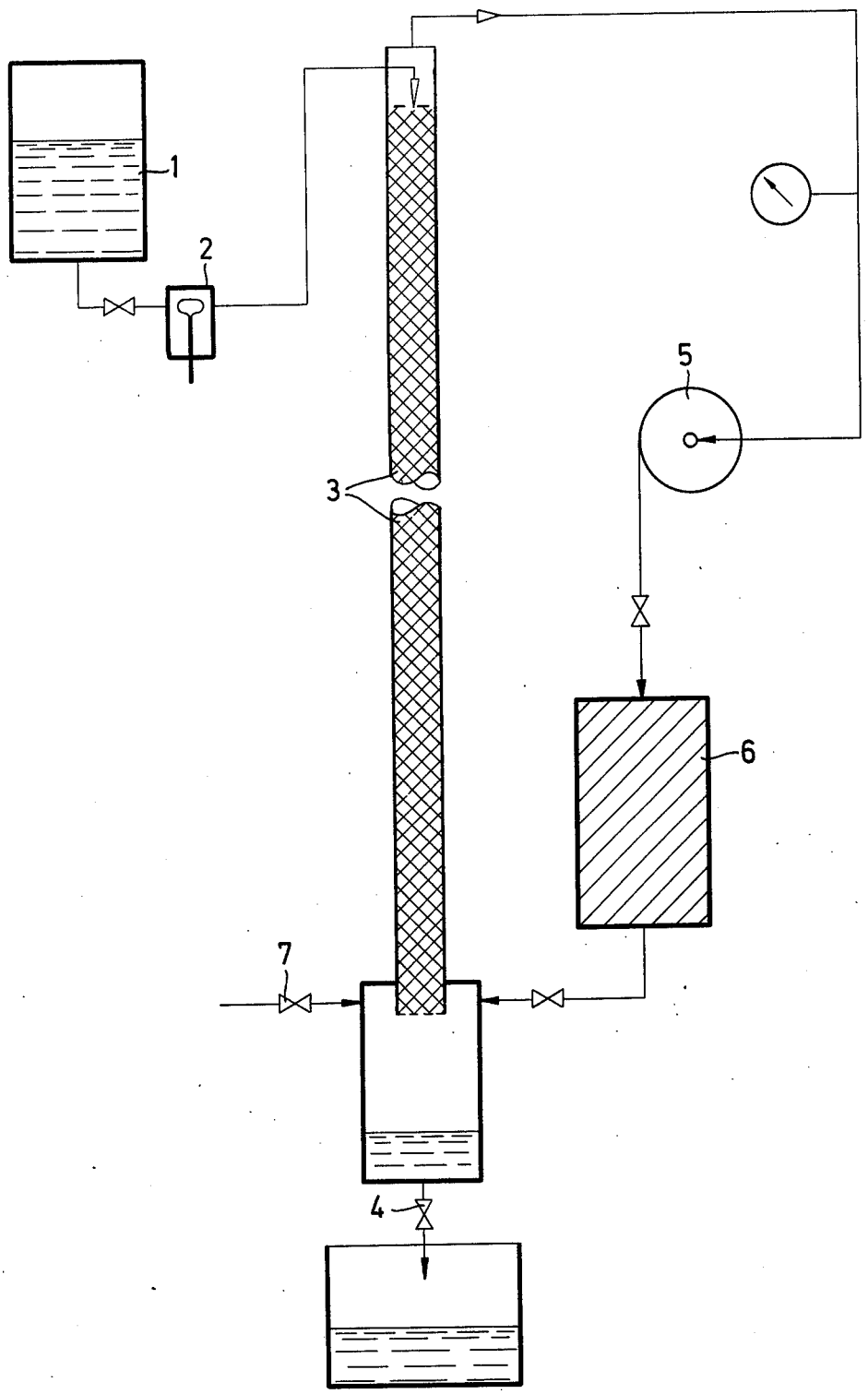
1
2
3
4
5
6
7

PROCESS FOR DEODORIZING FATS AND OILS

This application is a continuation of application Ser. No. 630,827, filed Nov. 11, 1975 (now abandoned), which, in turn, is a continuation of application Ser. No. 369,689, filed June 13, 1973 (now abandoned).

Crude fats and oils contain varying quantities of impurities such as phosphatides, mucins, free fatty acids, dyes and substances which affect the odour and flavour. These impurities are particularly undesirable in fats and oils used as foodstuffs. The crude fats are therefore refined by a process which is generally carried out in four successive stages:

1. Preliminary purification to remove the mucins and phosphatides;
2. Deacidification to remove most of the free fatty acids;
3. Decolorization;
4. Deodorization accompanied by reduction in the residual free fatty acid content.

The fourth stage, that of deodorization, is nowadays carried out almost exclusively by steaming the fat. This consists of treating the fat for a considerable time with steam at a relatively high temperature and very low pressure. Deodorization is generally the most difficult of the four stages of the refining process.

It has now been found that the substances which affect the odour and flavour can be completely removed and the free fatty acid content at the same time reduced to a minimum by treating the fat or oil with carbon dioxide at temperatures of 50° C. to 250° C. and pressures of 100 to 250 atmospheres.

Operating temperatures of 50° to 150° C. may be suitable but it may also be advantageous to employ temperatures above the given range, e.g. above 100° C., e.g. 150° to 200° C.

Treatment of the fats or oils with carbon dioxide is preferably carried out in countercurrent. A simple method of carrying out this operation, for example, consists of introducing the impure starting material into the top of a column filled with filling bodies and passing the carbon dioxide through the column from below upwards. The stream of carbon dioxide leaving the top of the column carries the unwanted impurities with it.

According to the invention, the carbon dioxide is preferably circulated and at least part of the impurities taken up by the stream of carbon dioxide is removed before the carbon dioxide is returned to the column together with the starting material which is required to be purified. This removal of unwanted impurities can be carried out in known manner by adjusting the carbon dioxide to below critical conditions or by lowering the pressure and/or raising the temperature when the carbon dioxide is in the above critical range.

It has been found, however, and this is an important new finding of general importance, that removal of impurities from a stream of carbon dioxide which is under above critical conditions can also be achieved by conducting the stream of carbon dioxide which is loaded with impurities through an adsorbent, preferably a solid adsorbent such as active charcoal. Although the method of purifying a stream of gas at below critical conditions by means of solid adsorbents is already known, it was not foreseeable how such adsorbents would behave in streams of gas loaded with impurities at above critical conditions.

It was surprisingly found that simply treating the contaminated stream of carbon dioxide with a solid adsorbent is sufficient to ensure that the carbon dioxide can be used again for the stage of deodorization. Substantial changes in pressure and/or temperature before or during the treatment with adsorbent are not necessary. This finding provides the possibility of a very simple and inexpensive process of circulation by which the stream of carbon dioxide kept under the predetermined conditions of pressure and temperature can first be brought into contact with the fats or oils which are to be purified, preferably in countercurrent, after which the stream of carbon dioxide now loaded with unwanted impurities is conducted over an adsorbent. This adsorbent is replaced by a fresh supply of adsorbent when its purifying power for the contaminated stream of carbon dioxide drops too low.

The process according to the invention has particular significance for the purification of fats and oils of natural and particularly vegetable and/or animal origin but may also be important for synthetically produced oils and fats.

The process is not only simple and extremely efficient in operation but in particular also obviates the risk of unwanted hydrolysis of the fats or oils which always exists when stage 4 is carried out by the known process of the art and which has therefore hitherto required this stage to be carried out under a high vacuum. The invention therefore also reduces the loss of neutral fats.

The process will now be explained with the aid of the following example in conjunction with FIG. 1.

EXAMPLE 1

The oil used in this experiment was a soya bean oil which contained about 0.4% of free fatty acids and had the typical odour and flavour of vegetable oils. The oil was stored in a tank 1 from which it was continuously fed into the top of a 15 m long column 3 through an injection pump 2. The column has an internal width of about 6 cm, was filled with glass balls and widened out towards the bottom. It was heated to 90° C. by means of a heating jacket (not shown) welded to the outside. The oil flowed over the glass balls to the bottom of the column and was continuously removed through valve 4.

At the same time, carbon dioxide was circulated through the column from below upwards at a pressure of 200 atmospheres by way of the centrifugal blower 5 and separator 6. The separator 6 was also heated to 90° C. from outside and filled with a solid adsorbent, in this case active charcoal.

The apparatus was filled with carbon dioxide through inlet valve 7 before deodorization was begun and the slight losses of carbon dioxide were replaced during the operation. Oil was fed into the top and removed from the botton of the column at the rate of about 5 kg/hour. The holdup was approximately 1.5 kg of oil.

The soya oil withdrawn from valve 4 was odourless and flavourless and had a residual free fatty acid content of about 0.02%.

EXAMPLE 2

A partly refined (deacidified and bleached) palm kernel fat containing about 0.3% of free fatty acids was deodorized in the same apparatus as in Example 1 and by the same process. An operating temperature of 150° C. and a pressure of 220 atmospheres were employed. The fat was passed through the apparatus at the rate of 5 kg/hour. The fat withdrawn from valve 4 was odourless and flavourless and had a residual free fatty acid content of about 0.015%.

EXAMPLE 3

A partly refined peanut oil containing 0.4% of free fatty acids was deodorized as in Examples 1 and 2. The process was carried out at a temperature of 200° C. and a pressure of 245 atmospheres. The peanut oil obtained was odourless and flavourless and had a residual free fatty acid content of 0.02%.

What is claimed is:

1. Process of deodorizing fat or oil characterized by the presence therein of odoriferous material, comprising contacting the fat or oil with carbon dioxide at a temperature of 150°-250° C. and a pressure of 100 to 250 atmospheres for the selective take-up by the carbon dioxide of odoriferous material thereby separating odoriferous material from the fat or oil.

2. Process according to claim 1, wherein the contacting is countercurrent.

3. Process according to claim 1, wherein the carbon dioxide containing odoriferous material is contacted with active charcoal absorbent for removal of odoriferous material from the carbon dioxide, and the carbon dioxide is circulated between the contacting with the fat or oil and the contacting with absorbent.

4. Process according to claim 3, wherein the contacting with fat or oil and the contacting with absorbent are carried out at substantially the same temperature and pressure.

5. Process according to claim 3, wherein the temperature is 150°-200° C.

6. Process according to claim 1, the fat or oil being soy bean oil.

7. Process according to claim 1, the fat or oil being palm kernel fat.

8. Process according to claim 1, the fat or oil being peanut oil.

* * * * *